US006123299A

United States Patent [19]

Zach, Sr.

[11] Patent Number: 6,123,299

[45] Date of Patent: Sep. 26, 2000

[54] ELECTRICAL OUTLET CURLING IRON

[76] Inventor: Howard L. Zach, Sr., 517 Juneau Ave., Fairbanks, Ak. 99701

[21] Appl. No.: 09/345,424

[22] Filed: Jul. 1, 1999

[51] Int. Cl.[7] ..... D06F 75/40; D06F 79/02; A47F 5/00; A47F 7/00; H01R 13/627

[52] U.S. Cl. ..... 248/117.1; 248/314; 439/365

[58] Field of Search ..... 248/117.1, 117.2, 248/117.3, 117.4, 117.5, 117.6, 117.7, 906, 314, 311.3, 176.2; D13/137.2; D8/363; 220/478; 439/105, 106, 142, 146, 147, 150, 365, 651, 148, 149, 143, 144, 145

[56] References Cited

U.S. PATENT DOCUMENTS

| | | | |
|---|---|---|---|
| 4,664,457 | 5/1987 | Suchy | 439/142 |
| 4,671,476 | 6/1987 | Yim | 248/117.2 |
| 4,826,049 | 5/1989 | Speer | 248/117.2 |
| 4,973,019 | 11/1990 | Baird et al. | 248/314 |
| 5,064,154 | 11/1991 | Payne | 248/121 |
| 5,318,356 | 6/1994 | Shelton | 248/314 |
| 5,485,931 | 1/1996 | Barr, Jr. | 211/70.6 |
| 5,605,466 | 2/1997 | Devlin et al. | 439/144 |
| 5,727,953 | 3/1998 | Pasholk | 439/365 |
| 5,743,415 | 4/1998 | Smart | 211/70.6 |
| 5,794,799 | 8/1998 | Collins et al. | 248/117.2 |
| 5,917,694 | 6/1999 | Denny | 248/314 |

*Primary Examiner*—Ramon O. Ramirez
*Assistant Examiner*—Jon A Szumny
*Attorney, Agent, or Firm*—Patent & Trademark Services; Thomas Zack; Joseph H. M. Glynn

[57] ABSTRACT

An apparatus to safely hold a heated curling iron to an existing electrical plug outlet. A conventional plug outlet has its face plate removed and the apparatus is retrofitted on an existing conventional plug outlet. A wall mounted unit consists of an expanded substitute face wall plate replacement with electrical plug inlets on its top and bottom surfaces. This retrofitted wall mounted unit has provision for the insertion of additional plug contacts and for mounting the curling iron holder at an adjustable angle. To adjustably mount the wall mounted unit to the curling iron holder, several protruding plugs in a circular configuration surround a larger center protruding member. Each of these plugs and member can engage complementarily shaped holes in the wall mounted unit. An end enlarged cap and spring retaining member combination allows the curling iron holder to be slightly pulled away from the wall mounted unit and then rotated to have this angular adjustment made. Additional features include side slot openings in the curling iron holder to dissipate heat, retaining rings to hold the two halves of the holder together and a protective screen barrier insertable into the curling iron holder.

4 Claims, 6 Drawing Sheets

ELECTRICAL OUTLET CURLING IRON

BACKGROUND OF THE INVENTION

This invention relates to an apparatus to safely hold a heated personal care instrument, such as a hair curling iron. Users have recognized that heated instruments need to have their heated parts shielded after use to avoid burns and injury to individuals, especially young persons, and property. In one earlier invention a curling iron safety holder used two coaxially arranged cylinders and insulation. Therein a support bracket is attached to the cylinders to support them and the held curling iron. Another invention disclosed a free standing stand for use with a hair dryer. With one invention a hair dryer caddy has vertically oriented thru-bores having opened and top ends with a slot-like side opening. Still another invention used adjustably mount holders for hair treatment appliances with a wall mounted base used to secure appliance members, including a heat resistant tube, adjustably mounted on the base. The present invention differs from this and the known prior art by providing for a wall mounted unit that can be retrofitted in place of an existing wall plug plate as will be described in detail hereafter.

DESCRIPTION OF THE PRIOR ART

Devices that are used to hold and support personal care electrical devices, such as hair curling irons and hair dryers, are known. For example, in the U.S. Pat. No. 4,973,019 to Baird et al a curling iron safety holder with a support bracket is disclosed. The holder consists of two coaxially arranged cylinders and insulation.

U.S. Pat. No. 5,064,154 to Payne discloses a free standing stand for use with a hair dryer.

U.S. Pat. No. 5,485,931 to Barr, Jr. discloses a hair dryer caddy having vertically oriented thru-bores that are opened at top ends with a slot-like side openings.

U.S. Pat. No. 5,743,415 to Smart discloses a wall mounted base with appliance securing members, including a heat resistant tube, adjustably mounted on the base.

SUMMARY OF THE INVENTION

This invention relates to surface supported personal care appliance holder that can be retro-fittedly mounted over an existing electrical plug outlet. The invention consists of a retrofit unit mounted on the support surface and an angularly adjustably mounted appliance holder.

It is the primary object of the present invention to provide for an improved personal care appliance holder that can be mounted over an existing electrical plug outlet.

Another object is to provide for such an apparatus having a unit mounted on the support surface in place of the existing face plate for the electrical outlet and an electrical appliance holder adjustable attached to the wall mounted unit.

These and other objects and advantages of the present invention will become apparent to readers from a consideration of the ensuing description and the accompanying drawings.

DESCRIPTION OF THE PREFERRED EMBODIMENT

Figure 1:
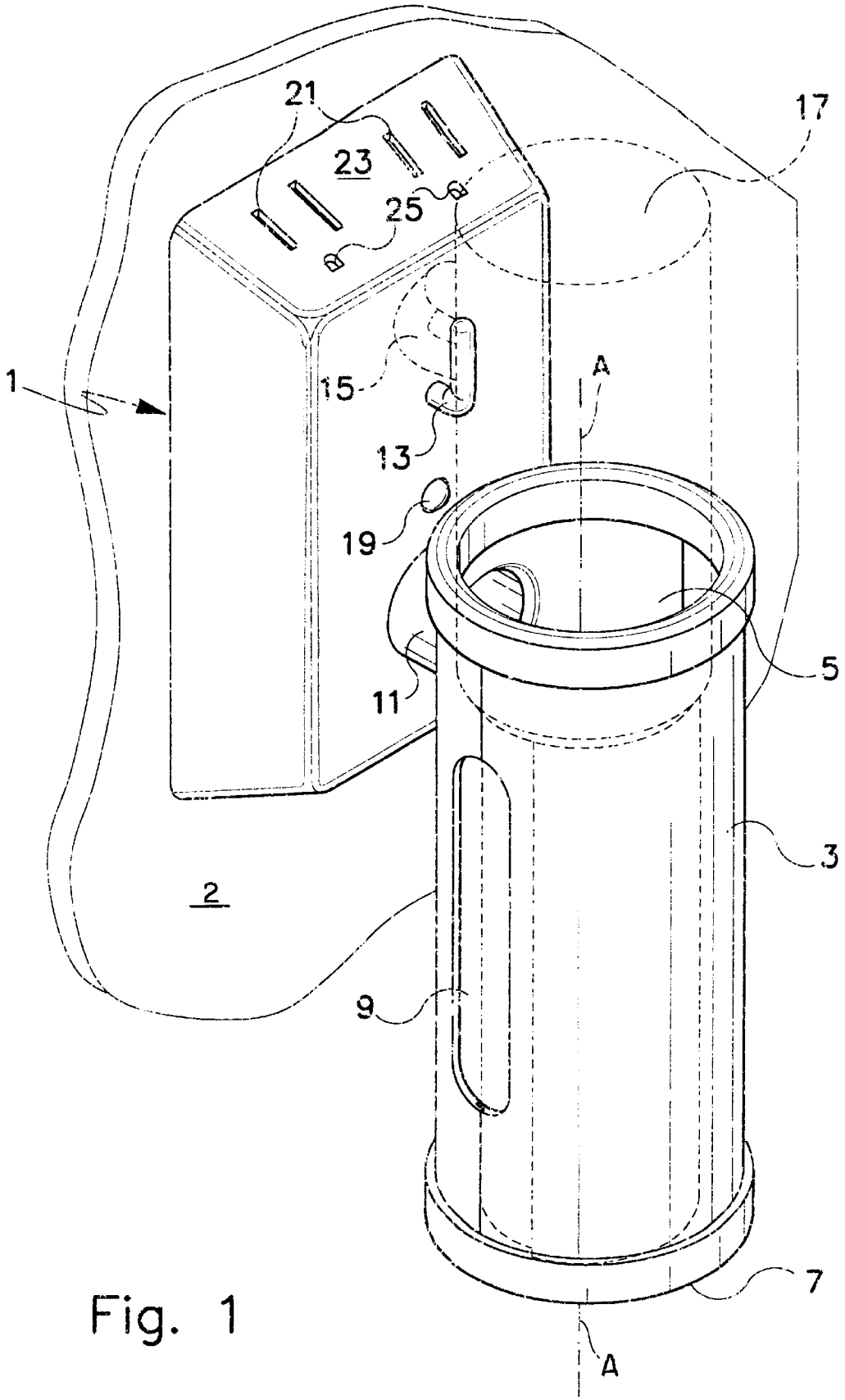
FIG. 1 is a perspective view of the present invention.

FIG. 1 is a perspective view of the present invention. The inner or wall mounted unit 1 is plugged into an existing electrical wall plug outlet (not shown and behind unit 1) after the normally existing face plate on wall 2 for that outlet has been removed. Attached to the unit 1 in an angularly adjustable manner is the appliance holder 3. This holder has a hollow center and is cylindrically shaped with two opened opposite ends 5 and 7. Two vertical opposite side slots 9, one of which is shown, extend into the hollow interior and are used in conjunction with the upper and lower holder openings to assist in the dissipation of heat from an inserted hot curling iron 17 (shown in dotted line format). A lower safety screen 41, not shown in this figure but see FIG. 4, covering the lower opening 7 prevents a person from touching the heated end of the curling iron which is inserted heated end down into the holder from the top opening 5. The holder 3 may be made of any material that is capable of withstanding high temperatures such as metal, ceramic or plastic material.

The holder 3 can be rotated relative to the unit 1 on the support coupling 11 partially shown in this figure. After the desired orientation is obtained between these two members, this angular orientation can be fixed by releasing the holder 3 to allow it to be pulled towards the base unit 1 as will be described in detail afterwards. Located on wall mounted unit 1 is an electrical cord holding hook protrusion 13 on which the extending electrical cord 15 (shown in dotted line format) from the holder inserted curling iron 17 may be wrapped around. A screw 19 whose head is shown fits through a hole in the surface of unit 1 and into the existing threaded screw receiving hole of the existing plug outlet vacated when the face plate is removed. Such face plates normally have a single center hole for a retaining screw to fit into and hold the face plate to the plug outlet. Two of the four sets of three electrical plug openings 21 are shown on upper outer surface 23 of unit 1. An identical set of two plug openings exists on the lower surface of unit 1 opposite the surface 23. Each set of plug openings has two plug openings and a third ground plug insertion opening 25 used to insert the conventional three end plugged ends of an electrically operated appliance, such as a heatable curling iron, into the unit 1. Unit 1, as described in more detail hereafter, has its own internal wiring, contacts and plug receptors to electrically connect the three openings from each set with the existing openings of the existing electrical plug outlet.

Figure 3:
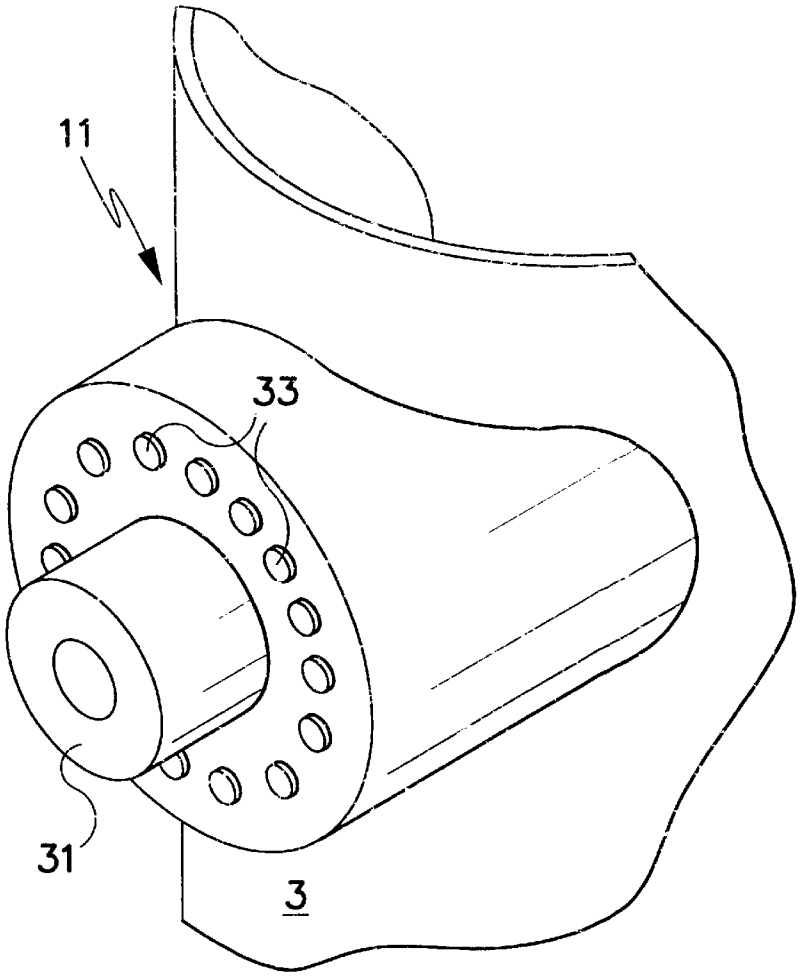
FIGS. 2 and 3 are enlarged views of a coupling used to join the appliance holder unit to a wall mounted base.
Figure 2:
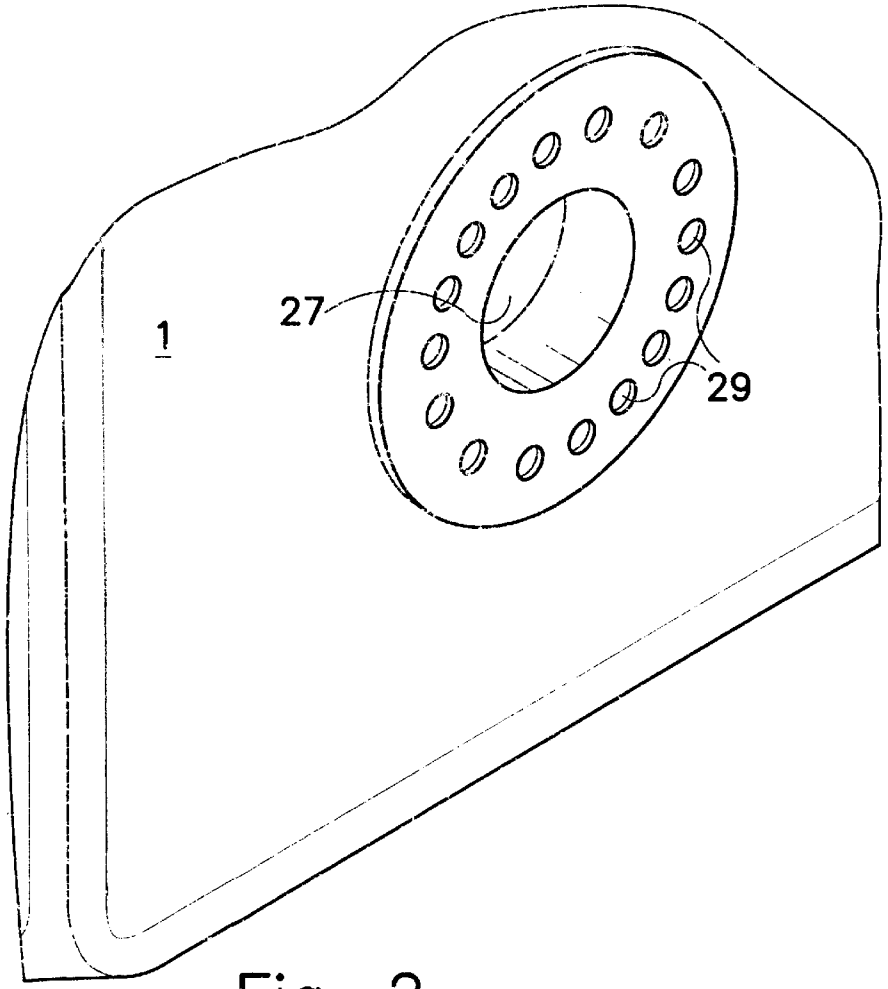

FIGS. 2 and 3 are enlarged views of the existing coupling 11 used to join the appliance holder unit 3 to the wall mounted base unit 1. Female receptor units consisting of a large center hole 27 and surrounding circular oriented smaller identical holes 29 are located on the lower front plate of unit 1 which is partially shown in FIG. 2. Mating with these receptors in unit 1 are the male protrusions in holder unit 3 shown in FIG. 3. The male protruding members consists of a large center protruding member 31 surrounded in a circular pattern by smaller identical raised members 33. Normally, the number of smaller male raised members 33 are spaced exactly the same distance apart as the same number of smaller female receptor units 29 and are complementary engageable with them. This permits all of the female receptors in unit 1 to be engaged with one of the male protruding units in unit 3 in a tight "snap fit" manner. This arrangement allows the attached unit 3 to have different angular orientations relative to the fixed base unit 1 by first selectively pulling out the inserted center member 31 away from the the center female opening 27 and then rotating the unit 3 to the desired orientation. After this action takes place, the member 31 is released and an internal retaining mechanism with a spring in unit 1 pulls member 31 towards the large center receptor hole 27 along with the smaller male units 33. This causes all male units 33 to individually mate with each of the small opening female receptors 29. Coupled with the internal spring retaining mechanism, see FIG. 6, this tight fit between all male and female members insures that the angular orientation between the units 1 and 3 will remain until unit 31 is again pulled outwardly from engagement with its seated retaining receptor.

Figure 4:
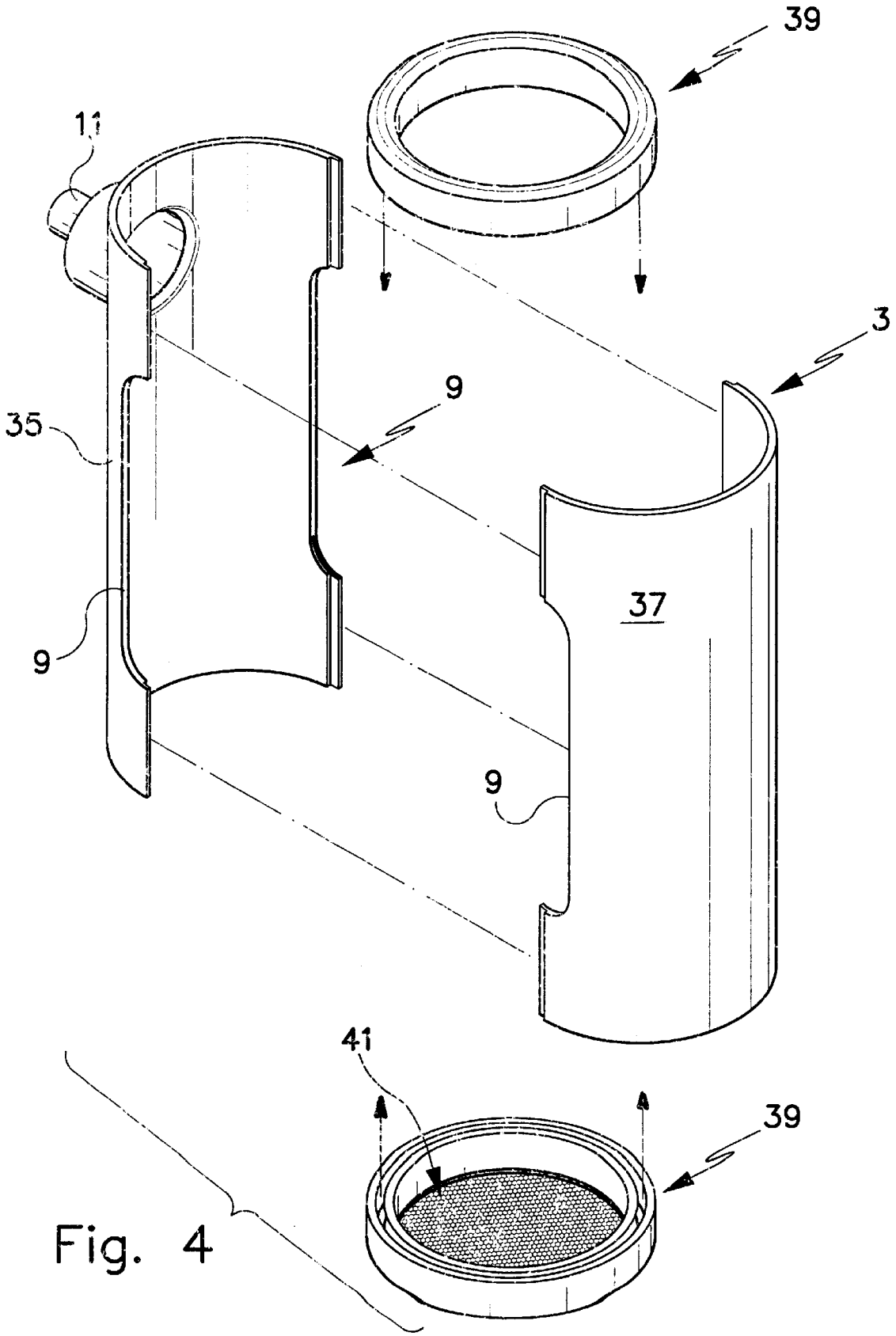
FIG. 4 is a cross-sectional perspective view of the appliance holder taken along line A—A of FIG. 1 which has been exploded.

FIG. 4 is a cross-sectional perspective view of the appliance holder 3 taken along line A—A of FIG. 1 as viewed in the direction of the arrows and then exploded to show its individual parts. The side 35 of holder 3 facing unit 1 has the protruding male coupling 11 shown in FIG. 3 fixed to its surface. Joinable to half side 35 is the facing outwardly facing half side 37 of unit 3. Both half sides 35 and 37 have complementarily fitting side edges that when joined together result in the two opposite side heat releasing slots 9 being formed between them. The two O-ring shaped members 39 are interchangeable and fit over the opposite ends of the joined half sides 35 and 37 and assist, in conjunction with the screen 41, in retaining the two half sides together. The mating edges of the members 39 and the ends of sides 35 and 37 can be made tongue and groove to prevent shifting between these mating elements. The smaller diameter screen 41, previously mentioned with respect to FIG. 1, fits into the larger diameter inner ring lower of the members 39 and acts a lower barrier to one inserting their finger(s) or anything else into the opened lower holder end near where the hot tip of an inserted curling iron.

Figure 5:
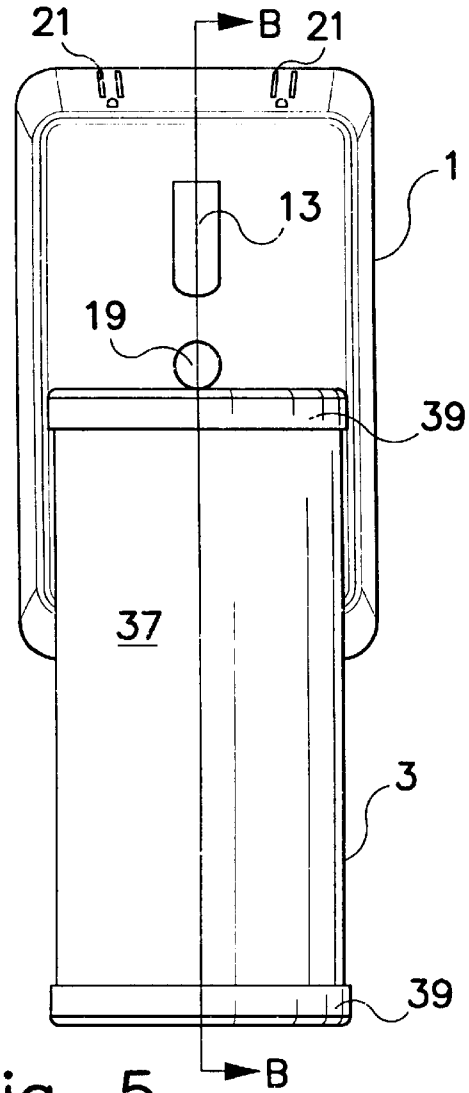
FIG. 5 is a front view of the invention.

FIG. 5 is a front view of the invention looking directly towards the wall 2. In this view the holder unit 3 is in front of the wall mounted unit 1. The upper and lower two O-ring shaped retaining members 39 are mounted on the ends of the holder unit 3. The two side slots 9 are not visible nor is the innermost holder half side 35. The cord retaining member 13 is shown above the screw retaining hole with the screw 19 inserted therein.

Figure 6:
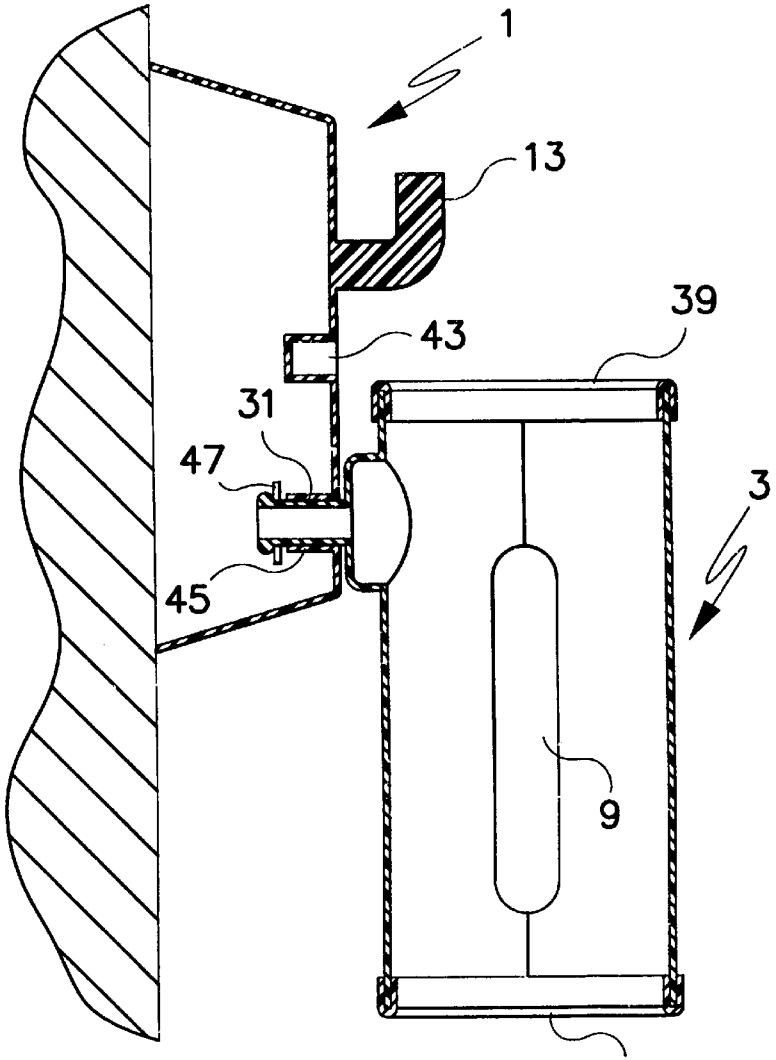
FIG. 6 is a side cross-sectional view of the invention as viewed along line B—B of FIG. 5 in the direction of the arrows.

FIG. 6 is a side cross-sectional view of the invention as viewed along line B—B of FIG. 5 in the direction of the arrows. In this view the screen 41 is not shown and the screw 19 has been omitted. The indented hole 43 for the screw 19 in unit 1 is visible as well as the inserted male end 31 of coupling 11. A coil spring 45 encircles the inserted end of male end 31 and is retained in position on the end of this member by an enlarged retaining end cap 47. With this arrangement of components, the inserted male member 31 in unit 3 may be slightly pulled away from the base unit 1 to allow for the adjustment of the angular orientation between the two units 1 and 3. Also shown in this figure is the opposite side slot 9 and a profile of the cord retaining hook member 13.

Figure 7:
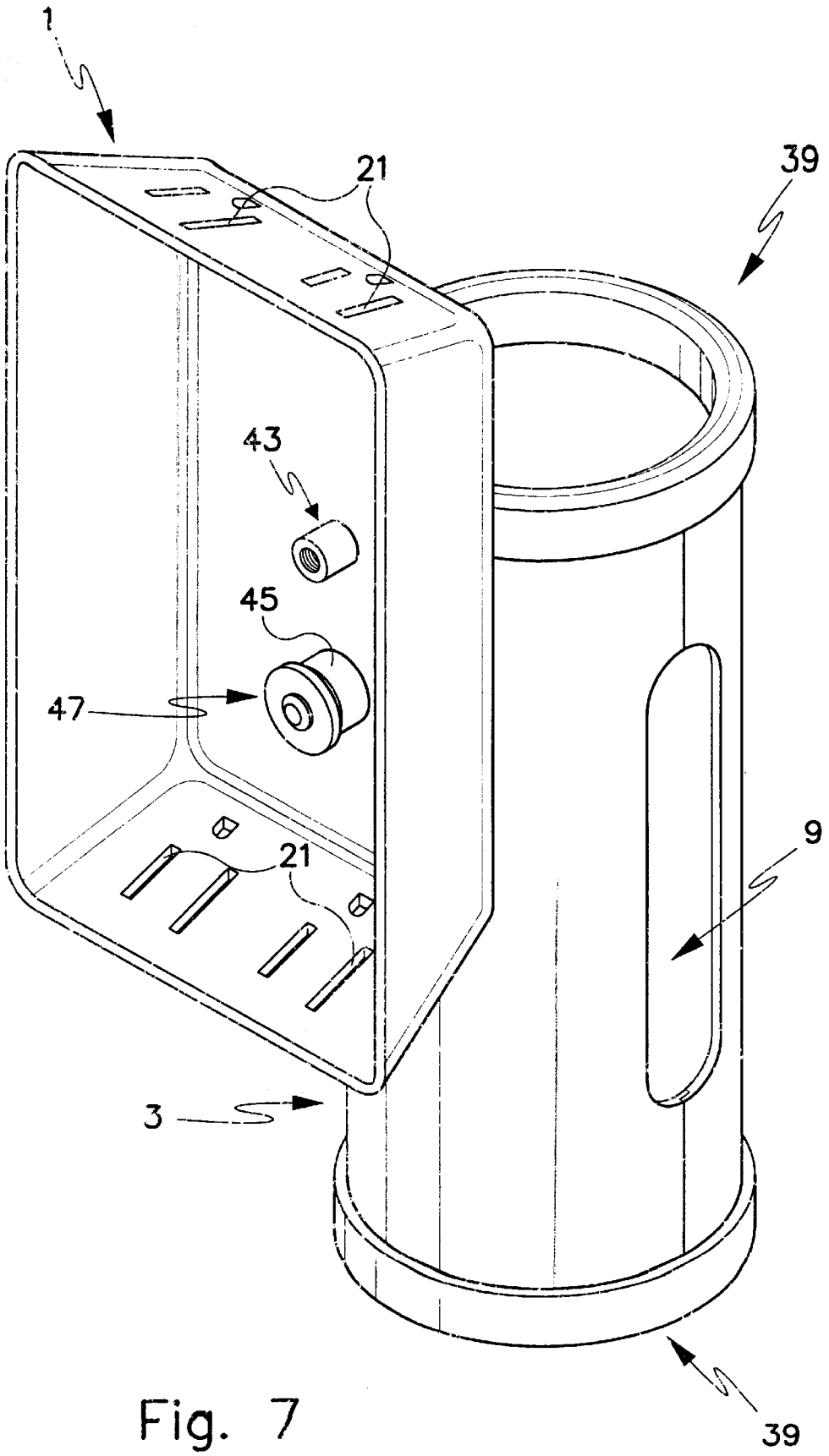
FIG.7 is a near perspective view of the wall mounted unit showing the appliance holder mounted on it.

FIG. 7 is a rear perspective view of the wall mounted unit 1 looking away from the wall 2 showing the appliance holder 3 mounted on it. The enlarged spring retaining end 47 fixed to the end of member 31 has the spring 45 between it and the inner wall of unit 1. The four sets of three electrical plug openings 21, two on the top and two on the bottom surfaces of unit 1, are more clearly visible in this view as well as the indented hole opening 43 for the unit's wall retaining screw 19. One of the appliance holder's two side venting slots 9 is just out of view.

Figure 8:
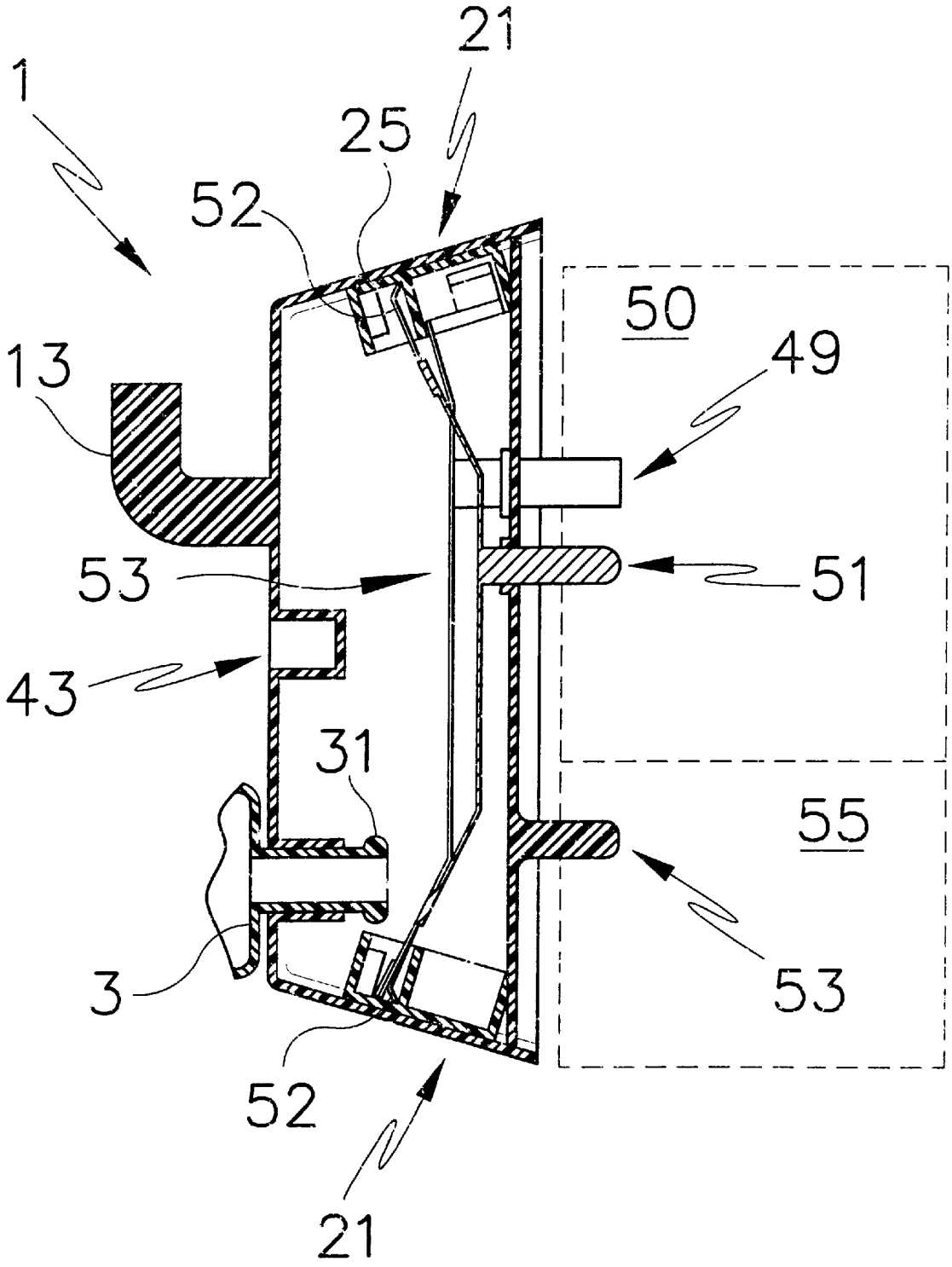
FIG. 8 is a side cross-sectional view of the invention shown with its internal added plug and conductive members.

FIG. 8 is a side cross-sectional view of the invention shown with added contacts, plug and wire members. This view is essentially the reverse view of the FIG. 6 view of the base unit 1 but with added electrical internal contacts, plugs and wires to electrically connect the unit into an conventional existing electrical plug outlet 50, shown in dotted line format. The mating protrusion 31 is shown and the remainder of unit 3 is only partially shown. The upper and lower electrical brass contacts 52 mounted to the interior side of unit 1 are connected by internal wires 53 to the unit's four interior plugs 49 (two) including the two ground plugs 51 and 53. The lower ground plug 53 is spaced from the other plugs to permit it to be inserted into the opening of a lower existing conventional wall mounted plug set 55( shown in dotted line format) whose two electrical conductive plug openings are not engaged by any of the internal plugs in unit 1. The top two parallel electrically conductive plugs 49 are operatively connected to the two inlets for the upper operative plug openings in the conventional wall mounted unit 50 with the ground 51 inserted into the same conventional unit's ground opening. Proper spacing between the mating plugs in unit 1 and the engaged plug openings in the existing conventional outlet plug units 50 and 55 is necessary with this set up.

It should be clear that the described preferred embodiment provides a safe place to hold hot personal care appliances, such as curling irons. This embodiment may be installed over an existing wall plug outlet in minutes by simply taking off the face plate and then plugging in the plugs 49, 51 and 53. Homes, hotels, motels and other establishments may provide for such added retrofitted units. Inserting screw 19 into hole 43 and into the screw hole of the removed face plate provides for a more permanent attachment. It should be clear that the number of individual plug inlets may easily be increased from the four shown to any desired number by varying the number of plug inlet holes and the internal connecting contacts and wiring and plugs to accommodate the added number.

By providing for a conveniently located holder for the hot appliance, burns to the counter, adjacent furniture, the nearby floor and carpets, etc. and to persons, especially young children, are greatly reduced or eliminated altogether. The angular adjustment between the holder and the base unit permits the unit to be turned 180 to allow the plugs from the top or bottom to be used as desired while orienting the holder at a convenient angle to receive the appliance. Lastly, the holder unit's lower screen protects a user from accidentally or intentionally touching the hot part of the appliance from the lower opening.

Although the preferred embodiment of the present invention and the method of using the same has been described in the foregoing specification with considerable details, it is to be understood that modifications may be made to the invention which do not exceed the scope of the appended claims. Modified forms of the present invention done by others skilled in the art to which the invention pertains will be considered infringements of this invention when those modified forms fall within the claimed scope of this invention.

What I claim as my invention is:

1. An apparatus to safely hold a heated personal care appliance that is mountable to an existing electrical plug outlet comprising:

a wall mountable unit having an electrical plug attachment means adapted to electrically connect the unit to an existing electrical wall plug outlet;

a personal care appliance holder adjustably attached to said wall mountable unit by a first protruding member of the appliance holder which engages a first opening in the wall mounted unit, said appliance holder having an outer surface with through openings adapted to dissipate heat generated by a personal care appliance inserted into the appliance holder; and including a plurality of additional protruding members on said appliance holder, said additional protruding members being mounted around said first protruding member, each of said additional protruding members being engaged by an opening different from said first opening in the wall mounted unit whereby the angular orientation between the wall mounted unit and the appliance holder may be adjusted.

2. The apparatus as claimed in claim 1, wherein said appliance holder has a top opening and a bottom opening with an insertable barrier in the bottom opening.

3. The apparatus as claimed in claim 2, wherein said appliance holder has top and bottom retaining members to maintain said appliance holder together as a single unit.

4. An apparatus to safely hold a heated personal care appliance that is mountable to an existing electrical plug outlet comprising:

a wall mountable unit having an electrical plug attachment means adapted to electrically connect the unit to an existing electrical wall plug outlet; and a personal care appliance holder adjustably attached to said wall mountable unit by a first protruding member of the appliance holder which engages a first opening in the wall mounted unit, said appliance holder's first protruding member when inserted into said first opening in the wall mounted unit includes an enlarged end mounted cap and biasing member, said biasing member being mounted between said end cap and the wall mounted unit; and said appliance holder having a outer surface with through openings adapted to dissipate heat generated by a personal care appliance inserted into the appliance holder.

* * * * *